US005542853A

United States Patent [19]

Bouchan

[11] Patent Number: 5,542,853

[45] Date of Patent: Aug. 6, 1996

[54] SHUNTED ELECTRICAL CONNECTOR

[75] Inventor: Christophe Bouchan, Longjumeau, France

[73] Assignee: Molex Incorporated, Lisle, Ill.

[21] Appl. No.: 313,473

[22] Filed: Sep. 27, 1994

[30] Foreign Application Priority Data

Oct. 31, 1993 [EP] European Pat. Off. ..... 93 117 373.6

[51] Int. Cl.[6] ..... H01R 29/00

[52] U.S. Cl. ..... 439/188; 439/676; 439/514

[58] Field of Search ..... 439/188, 620, 439/507, 514, 515; 200/51.1

[56] References Cited

U.S. PATENT DOCUMENTS

| | | | |
|---|---|---|---|
| 4,804,339 | 2/1989 | Cohen | 439/188 X |
| 4,863,393 | 9/1989 | Ward et al. | 439/188 |
| 4,874,333 | 10/1989 | Reed | 439/514 |
| 4,952,170 | 8/1990 | Prituisky | 439/509 |
| 5,092,785 | 3/1992 | Chen | 439/188 OR |
| 5,108,300 | 4/1992 | Weber | 439/188 OR |
| 5,112,238 | 5/1992 | Cizin | 439/188 OR |
| 5,123,854 | 6/1992 | Petersen et al. | 439/188 |

*Primary Examiner*—David L. Pirlot
*Assistant Examiner*—Daniel Wittels
*Attorney, Agent, or Firm*—A. A. Tirva

[57] ABSTRACT

A modular jack type electrical connector includes a dielectric housing defining a plug-receiving cavity open at one end of the housing. A plurality of terminals are mounted on the housing with contact portions extending into the cavity. A shunt bridges at least a pair of the terminals. A passive electrical component is coupled directly to the shunt on the connector.

10 Claims, 2 Drawing Sheets

SHUNTED ELECTRICAL CONNECTOR

FIELD OF THE INVENTION

This invention generally relates to the art of electrical connectors and, particularly, to a shunted electrical connector of the modular jack type and, still further, to such a connector incorporating a passive electrical component coupled in series with the shunt.

BACKGROUND OF THE INVENTION

There are a variety of known shunted electrical connectors, including connectors of the modular jack type, wherein selected different terminals of the connector are shunted or shorted for various purposes. Examples of such connectors are shown in U.S. Pat. Nos. 4,863,393 to Ward et al, dated Sep. 5, 1989; 4,874,333 to Reed, dated Oct. 17, 1989; 4,952,170 to Pritulski, dated Aug. 28, 1990; and 4,123,854 to Petersen et al, dated Jun. 23, 1992, the latter patent being assigned to the assignee of this invention. All of these patents show one form or another of a modular jack type connector which includes such components as shorting elements, bridging cards, shunting strips and the like to shunt or short selective different terminals of the connectors, particularly when the connectors are not receiving a mating connector plug. For instance, the shunting elements may be used to maintain line continuity when no plug is inserted into the jack.

Generally, electrical connectors of the character described above include spring beam contacts which protrude from a portion of the jack housing into the receiving cavity of the jack. The contacts or terminals may be separated from each other by molded walls of the jack. The terminals include terminal portions, usually in the form of terminal pins, for mating with the terminals of a complementary electrical component. For instance, the terminal pins may form solder tails for insertion into holes in a printed circuit board. In some instances, the terminal pins or solder tails are arranged in a single row, and in other instances the terminal pins or solder tails are arranged in two rows.

It often is desirable to incorporate passive electrical components, such as resistors or capacitors, in the circuitry of the shunt and/or the shunted terminals. Heretofore, in order to incorporate such passive electrical components in the circuit, the components were incorporated somewhere outside the modular jack itself, such as in the printed circuit board with which the jack is interconnected. While it has become fairly easy to change the shunting characteristics of the jack, or even programming the shunt means itself, incorporating such passive electrical components in the printed circuit board would require customizing the board and the inherent cost and inventory problems associated therewith.

This invention is directed to solving those problems by a simple concept of incorporating the passive electrical components directly on the shunting device, itself, either on or within the jack.

SUMMARY OF THE INVENTION

An object, therefore, of the invention is to provide a new and improved shunted electrical connector, such as a modular jack type connector as described above, which incorporates a passive electrical component.

In the exemplary embodiment of the invention, the connector includes a dielectric housing defining a plug-receiving cavity open at one end of the housing. A plurality of terminals are mounted on the housing with contact portions extending within the cavity. A shunt bridges at least a pair of the terminals. The invention contemplates that a passive electrical component be coupled directly to the shunt on the connector.

In the preferred embodiment of the invention disclosed herein, the shunt is provided as a two-part component, and the passive electrical component is coupled in series between the two parts. As disclosed, the two-part shunt is fabricated of sheet metal material, and the passive electrical component is soldered or glued using conductive glue to the two parts. The shunt is illustrated as a resistor to provide a load in the shunted circuit, and the shunt and the passive electrical component are mounted within the dielectric housing of the connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
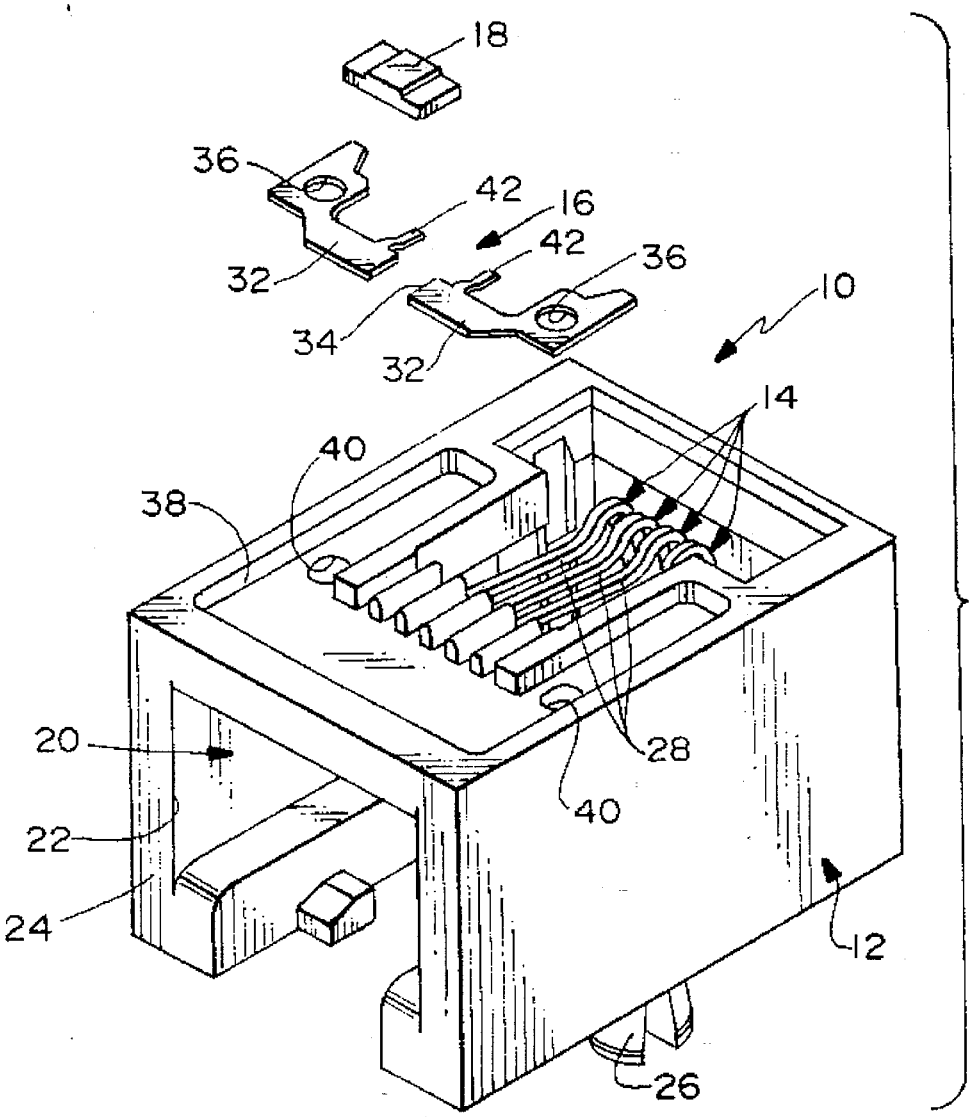
FIG. 1 is an exploded perspective view of a modular jack type connector incorporating the concepts of the invention.

Referring to the drawings in greater detail, the invention is embodied in a modular jack type electrical connector, generally designated 10, which includes a dielectric housing, generally designated 12. The housing mounts a plurality of terminals, generally designated 14. A two-part shunt means, generally designated 16 and seen best in FIG. 1, is provided for shunting or shorting a pair of selective different terminals. The invention contemplates incorporating a passive electrical component 18 coupled directly to shunt means 16 on or within connector housing 12, as will be described in greater detail hereinafter.

Housing 12 is a unitarily molded component of dielectric material, such as plastic or the like. As is known in the modular jack art, the housing defines a plug-receiving cavity, generally designated 20, which is open at a plug-receiving mouth 22 at one end 24 of the housing. The cavity is sized and shaped for receiving a complementary jack plug connector (not shown) which is inserted into cavity 20 from the open or mating end 24 of the housing. Housing 12 further includes one or more mounting pegs 26 for surface mounting the connector through appropriate holes in a printed circuit board, as is known in the art.

Terminals 14 have spring contact portions 28 which are coplanar in a single row and which extend within cavity 20 for engaging appropriate contacts of the complementary mating jack plug connector. The terminals also have pins or solder tails 30 (FIG. 3) which are insertable through appropriate holes in a printed circuit board (not shown). Whereas spring contact portions 28 are coplanar in a single row, pins 30 are offset and alternate in two distinct rows. The pins form solder tails for soldering to appropriate circuit means on the board and/or in the holes. In an alternate embodiment surface mount type terminals may be used.

Figure 3:
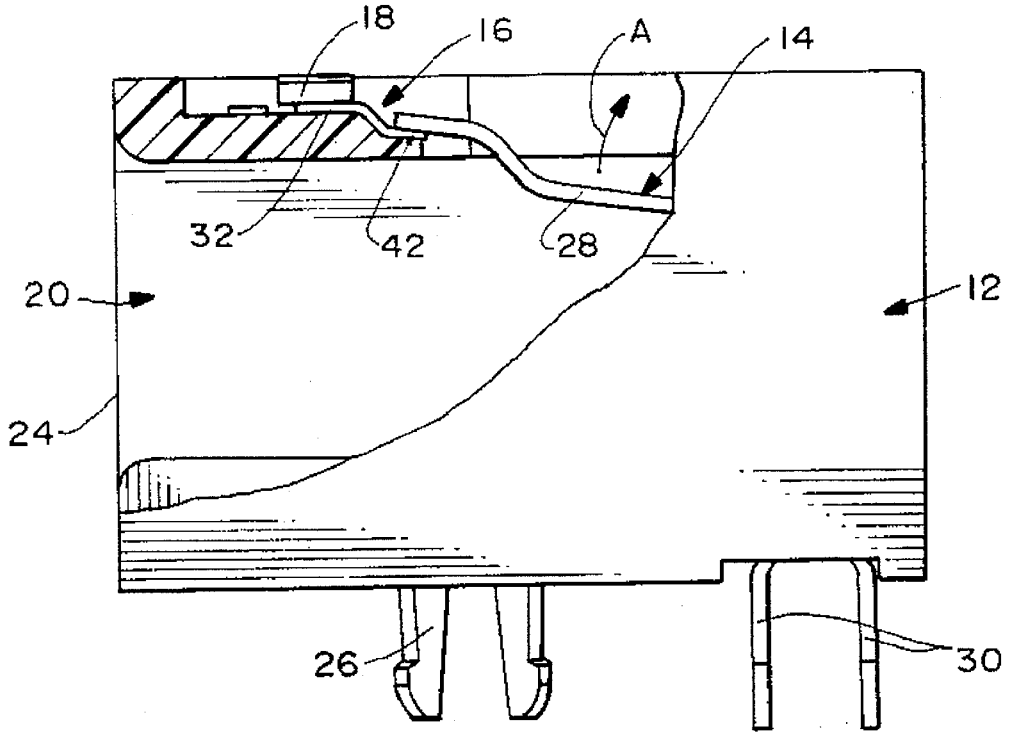
FIG. 3 is a side elevational view of the connector, partially cut-away to show the interengagement of the shunt and the terminals.

Shunt means 16 is provided in the form of a two-part component comprised of two parts 32 which are spaced apart to define a gap 34 therebetween. The shunt parts are stamped and formed from sheet metal material and include holes 36 for mounting the shunt parts within a recessed area 38 of housing 12. The holes may receive integral plastic staking posts of the housing, or the holes may be alignable with holes 40 of the housing for receiving appropriate mounting or fastening means. Each shunt part 32 includes a contact finger 42 which is engageable with a spring contact portion 28 of a selected one of terminals 14 as shown in FIG. 3 when no jack plug is inserted into cavity 20. In other words, the illustrated shunting scheme would be designed to maintain resistive line continuity when no plug is inserted into the jack. When a plug is inserted into the jack, the contacts on the plug will engage spring contact portions 28 of terminals 14 and move the spring contact portions upwardly in the direction of arrow "A" (FIG. 3) which, in turn, moves the spring contact portions off of contact fingers 42 of shunt parts 32.

Figure 2:
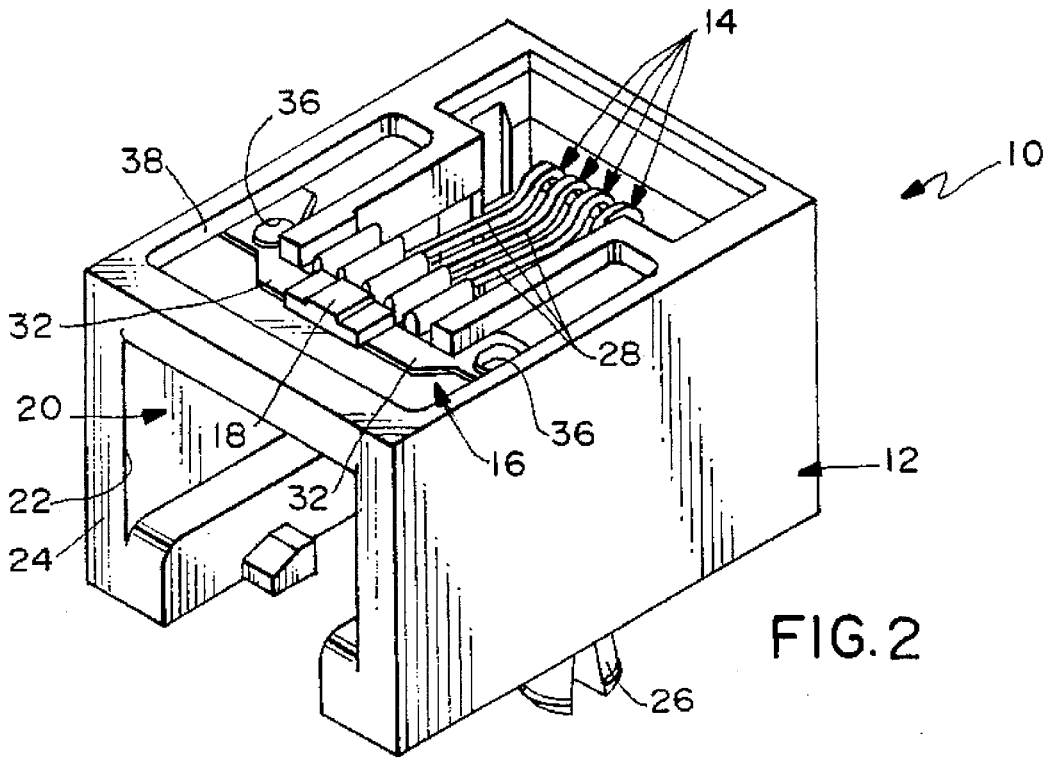
FIG. 2 is a perspective view of the connector with the two-part shunt and the passive electrical component mounted therewithin.

Generally, the invention contemplates incorporating passive electrical component 18 directly to shunt means 16 on or within connector housing 12. More particularly, as stated above, shunt parts 32 are separated by a gap 34 (FIG. 1) and this gap remains when shunt parts 32 are mounted within recessed area 38 of housing 12 as shown in FIG. 2. Passive electrical component 18, which may be a resistor to provide a load in the shunted circuit, simply is soldered or glused using conductive glue to shunt parts 32 spanning gap 34 as shown in FIGS. 2 and 3. Of course, other passive electrical components than a resistor are contemplated by the invention.

The simplicity of the invention is readily apparent. By providing a two-part shunt means, the passive electrical component can be electrically coupled in series with the shunt means simply by spanning the gap between the two parts of the shunt means. The printed circuit board to which the modular jack is connected does not have to be customized to incorporate the passive electrical component therewithin. The savings in cost, inventory and shear complexity are clear advantages of the invention.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a modular jack type electrical connector which includes a dielectric housing means defining a plug-receiving cavity open at one end of the housing means, a plurality of terminals mounted on the housing means with contact portions extending within the cavity, and a shunt bridging at least a pair of the terminals, wherein said shunt comprises a two-part component, and a passive electrical component is coupled in series between the two parts of the shunt.

2. In a modular jack type electrical connector as set forth in claim 1, wherein said passive electrical component comprises a resistor.

3. In a modular jack type electrical connector as set forth in claim 1, wherein the two-part shunt is fabricated of sheet metal material, and the passive electrical component is soldered to the two parts of the shunt.

4. In a modular jack type electrical connector as set forth in claim 1, wherein said shunt and said passive electrical component are mounted within the dielectric housing means.

5. A modular jack type electrical connector (10), comprising:

a dielectric housing means defining a plug-receiving cavity open at one end of the housing means;

a plurality of terminals mounted on the housing means with spring contact portions extending into the cavity;

a two-part shunt bridging at least a pair of the terminals, the shunt being fabricated of sheet metal material and being mounted within a recessed area of the housing means, the two parts of the shunt being separated by a gap; and a passive electrical component coupled directly between the two parts of the shunt, spanning said gap, whereby the passive electrical component is coupled in series with the two-part shunt.

6. The modular jack type electrical connector of claim 5 wherein said passive electrical component comprises a resistor.

7. In an electrical connector which includes a dielectric housing means mounting a plurality of terminals, and a shunt bridging at least a pair of the terminals, wherein the improvement comprises a passive electrical component coupled directly to the shunt on the connector wherein said shunt comprises a two-part component, and the passive electrical component is coupled in series between the two parts of the shunt.

8. In a modular jack type electric connector as set forth in claim 7, wherein the two-part shunt is fabricated of sheet metal material, and the passive electrical component is soldered to the two parts of the shunt.

9. In a modular jack type electrical connector as set forth in claim 8, wherein said shunt and said passive electrical component are mounted within the dielectric housing means.

10. In a modular jack type electrical connector as set forth in claim 7, wherein said passive electrical component comprises a resistor.

* * * * *